US009843871B1

(12) United States Patent
Nikookhoy et al.

(10) Patent No.: US 9,843,871 B1
(45) Date of Patent: Dec. 12, 2017

(54) METHOD AND APPARATUS FOR CHANNEL SELECTION IN EAR-TO-EAR COMMUNICATION IN HEARING DEVICES

(71) Applicant: Starkey Laboratories, Inc., Eden Prairie, MN (US)

(72) Inventors: Shahin Nikookhoy, Eden Prairie, MN (US); Brent Anthony Bauman, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 15/180,539

(22) Filed: Jun. 13, 2016

(51) Int. Cl.
*H04R 25/00* (2006.01)

(52) U.S. Cl.
CPC ..... *H04R 25/30* (2013.01); *H04R 25/505* (2013.01); *H04R 25/552* (2013.01)

(58) Field of Classification Search
None
See application file for complete search history.

(56) References Cited

U.S. PATENT DOCUMENTS 8,737,653 B2 * 5/2014 Woods ..... H04R 25/552 381/23.1
8,768,478 B1 * 7/2014 James ..... A61N 1/36032 607/57
9,014,406 B2 * 4/2015 Thomsen ..... H04R 25/552 381/317
2001/0041537 A1 11/2001 Simonsson et al.
2010/0054512 A1 3/2010 Solum
2010/0135500 A1 * 6/2010 Derleth ..... H04R 25/552 381/23.1
2011/0150249 A1 * 6/2011 Klemmensen ..... H04R 1/1008 381/312
2012/0128164 A1 * 5/2012 Blamey ..... H04R 5/04 381/28
2014/0341406 A1 11/2014 Gudiksen
2015/0245129 A1 * 8/2015 Dusan ..... H04R 1/1083 381/71.6

FOREIGN PATENT DOCUMENTS

EP 2498514 A1 9/2012
EP 2779700 A1 9/2014

OTHER PUBLICATIONS

"European Application Serial No. 17175802.2, Extended European Search Report dated Oct. 10, 2017", 7 pgs.

* cited by examiner

*Primary Examiner* — Paul Huber
(74) *Attorney, Agent, or Firm* — Schwegman Lundberg & Woessner, P.A.

(57) ABSTRACT

A pair of binaural hearing devices can dynamically assess and select a channel from a plurality of frequency channels suitable for ear-to-ear communication with each other. In various embodiments, the hearing aids can each initiate a channel assessment by calibrating a channel quality threshold and transmitting a packet including the channel quality threshold to the other hearing aid. The other hearing aid can then receive the packet, measure the quality parameter on the packet, and compare the measured value of the quality parameter to the received channel quality threshold to determine whether the channel is suitable for the ear-to-ear communication.

20 Claims, 5 Drawing Sheets

METHOD AND APPARATUS FOR CHANNEL SELECTION IN EAR-TO-EAR COMMUNICATION IN HEARING DEVICES

TECHNICAL FIELD

This document relates generally to hearing systems and more particularly to hearing devices that select a suitable channel for ear-to-ear communication.

BACKGROUND

Hearing devices provide sound for the wearer. Some examples of hearing devices are headsets, hearing aids, speakers, cochlear implants, bone conduction devices, and personal listening devices. Hearing aids provide amplification to compensate for hearing loss by transmitting amplified sounds to their ear canals. In various examples, a hearing aid is worn in and/or around a patient's ear. The sounds may be detected from a patient's environment using the microphone in a hearing aid and/or received from a streaming device via a wireless link. Wireless communication may be performed for programming the hearing aid and receiving information from the hearing aid. In examples of binaural hearing aids, wireless communication may also be performed between the hearing aids when being worn in and/or around the opposite ears of the wearer (referred to as "ear-to-ear communication"). The performance of such wireless communication is affected by various environmental factors including loading effects of the wearer's head on the antennas of the hearing aids. As these factors change with time and wearer, there is a need for ongoing monitoring and adjustment of wireless communication, including the ear-to-ear communication, for hearing aids to ensure acceptable performance.

SUMMARY

A pair of binaural hearing devices can dynamically assess and select a channel from a plurality of frequency channels suitable for ear-to-ear communication with each other. In various embodiments, the hearing aids can each initiate a channel assessment by calibrating a channel quality threshold and transmitting a packet including the channel quality threshold to the other hearing aid. The other hearing aid can then receive the packet, measure the quality parameter on the packet, and compare the measured value of the quality parameter to the received channel quality threshold to determine whether the channel is suitable for the ear-to-ear communication.

This summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
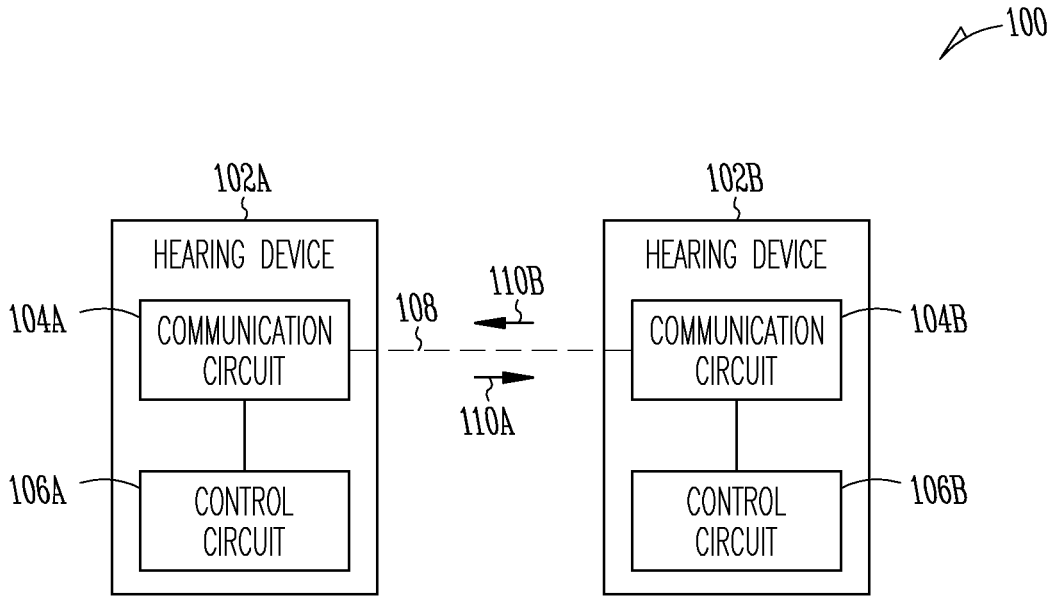
FIG. 1 is a block diagram illustrating of an exemplary embodiment of a hearing system including a pair of hearing devices capable of ear-to-ear communication.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

This document discusses a hearing system including a pair of hearing devices configured to be worn in or about ears of a wearer. These hearing devices, such as hearing aids, can perform wireless communication with each other when being worn by the wearer. Such wireless communication is referred to as "ear-to-ear communication" as it is between a hearing device worn in or about an ear of the wearer and another hearing device worn in or about the opposite ear of the wearer.

In one example, the ear-to-ear communication between two hearing aids was performed via a wireless communication link having a plurality of channels each corresponding to a frequency range. It was observed that the path loss from one hearing aid to the other hearing aid was not consistent across these channels. When one hearing aid is transmitting on a particular channel, the other hearing aid is tuned to the same channel for receiving. When a low gain was observed for a channel, the wireless link for the ear-to-ear communication would be unsatable for the frequency of that channel. When a high level of noise or interference was generated on a channel, the wireless link for the ear-to-ear communication would also be unstable for the frequency of that channel. To quantify this problem, the power received by each hearing aid was measured using the on-chip received signal strength indicator (RSSI) register in the radio of the hearing aid. The measurement setup included two hearing aids. One of the hearing aids sent a packet on a specified channel and the other hearing aid used its RSSI register to quantify the level of power received with that packet on the specified channel. The measured level of power varied significantly across different channels and differed significantly across different wearers. Variation in the level of power across the different channels was measured above 6 dB in some measurements. This suggests a need for selecting a suitable or optimal channel for ear-to-ear communication for binaural hearing devices such as binaural hearing aids.

The present subject matter can allow for selection of a suitable channel for ear-to-ear communication between a pair of binaural hearing devices. In various embodiments, the channel selection can be updated dynamically based on changing measures of wireless communication quality across the channels. The selection is controlled using both hearing devices, in contrast to a master-slave relationship that is widely used in devices equipped with Bluetooth® wireless communication capabilities. While hearing aids are specifically discussed in this document as an examples of the hearing devices, the present subject matter can be applied in any hearing devices that perform ear-to-ear communication with each other.

In various embodiments, a pair of hearing aids can control the channel selection using a channel quality threshold representative of a minimum quality required for the ear-to-ear communication. The channel quality threshold can be the minimum value of a quality parameter measureable using each hearing aid. The quality parameter can be any parameter indicative of quality of the ear-to-ear communication. One example of the quality parameter includes a signal-to-noise ratio (SNR). In one embodiment, an RSSI value is measured by a hearing aid on a signal that is transmitted from the other hearing aid and received by the hearing aid. Another RSSI value, referred to as RSSIQ value (RSSI when channel is Quiet), is measured by the hearing aid when no signal is transmitted from the other hearing aid. By subtracting the RSSIQ value from the RSSI value (i.e., RSSI−RSSIQ), the SNR (i.e., an RSSI−RSSIQ value) is obtained. While the SNR being the RSSI−RSSIQ value is specifically discussed as an example of the quality parameter in this document, other quality parameter that can be measured by the hearing aids can also be used without departing from the present subject matter. In one embodiment, the hearing aids each include RSSI on its radio to the power received at each channel for the channel selection as discussed in this document. In other embodiments, a variety of other on-chip power measurement peripherals can be used as the quality parameter for the channel selection.

In various embodiments, the hearing aids can each initiate a channel assessment by transmitting the channel quality threshold it produces to the other hearing aid. The other hearing aid can measure the quality parameter from the received signal and compare the measured value of the quality parameter to the received channel quality threshold to determine whether the currently used channel is suitable for the ear-to-ear communication. Such a channel assessment can be performed while the hearing aids play audio.

FIG. 1 is a block diagram illustrating an exemplary embodiment of a hearing system 100. System 100 includes a pair of hearing devices 102A-B that are capable of performing ear-to-ear communication using a plurality of channels of a wireless communication link 108 when hearing device 102A is worn in or about the first ear of the wearer and hearing devices 102B is worn in or about the second ear of the wearer. The first ear can be either the right ear or the left ear, and the second ear is the opposite ear of the same wearer.

Hearing device 102A can include, among other things, a communication circuit 104A and a control circuit 106A. Communication circuit 104A can receive a signal 110B transmitted from hearing device 102B using a specified channel selected from the plurality of channels. Signal 110B carries a packet including a channel quality threshold. The channel quality threshold is a minimum value of a quality parameter determined by hearing device 102B for the specified channel. Control circuit 106A can measure the quality parameter for the specified channel and determine whether the specified channel is useable based on the measured value of the quality parameter and the channel quality threshold included in the received packet. Control circuit 106A can also calibrate another channel quality threshold for the specified channel for transmitting to hearing device 102B.

Hearing device 102B can include, among other things, a communication circuit 104B and a control circuit 106B. Communication circuit 104B can receive a signal 110A transmitted from hearing device 102A using the specified channel. Signal 110A carries a packet including the other channel quality threshold, which is the minimum value of the quality parameter determined by hearing device 102A for the specified channel. Control circuit 106B can measure the quality parameter for the specified channel and determine whether the specified channel is useable based on the measured value of the quality parameter and the channel quality threshold included in the received packet. Control circuit 106B can also calibrate the channel quality threshold for the specified channel for transmitting to hearing device 102A.

In various embodiments, signals being transmitted between hearing devices, such as signals 110A and 110B, can carry audio information for delivering to the wearer and/or control information for operation of the hearing devices. In various embodiments, control circuits 106A-B can each select a different channel from the plurality of channels to be the new specified channel in response to a determination that the specified channel is not suitable. Control circuits 106A-B can initiate an assessment of the new specified channel by transmitting a calibrated channel quality threshold to the other hearing device. In various embodiments, control circuits 106A-B can initiate an assessment of the specified channel by transmitting the calibrated channel quality threshold to the other hearing device on a continuous or periodic basis or according to another schedule, without interrupting signal transmitted via communication link 108.

Figure 2:
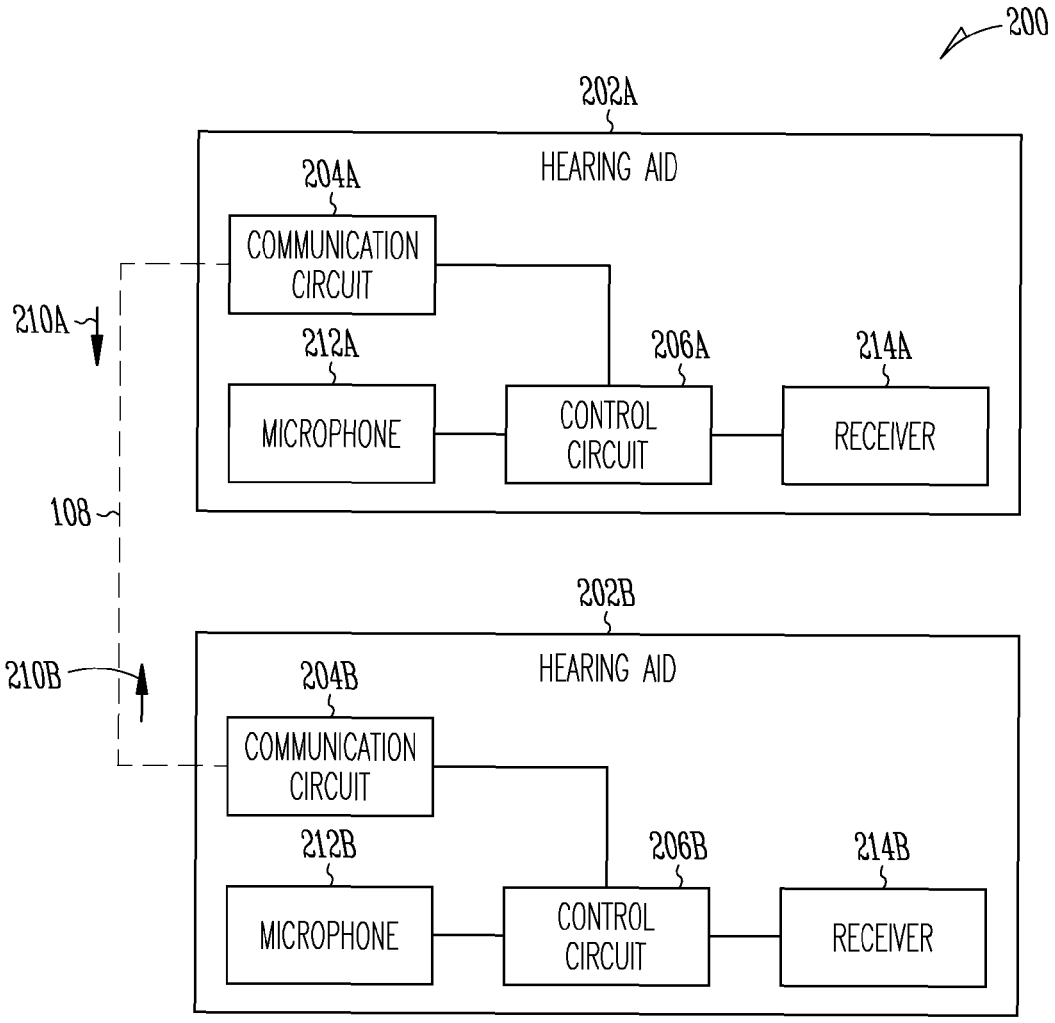
FIG. 2 is a block diagram illustrating an exemplary embodiment of a hearing system including a pair of hearing aids capable of ear-to-ear communication.

FIG. 2 is a block diagram illustrating an exemplary embodiment of a hearing system 200. Hearing system 200 represents an exemplary embodiment of hearing system 100 and can include a pair of hearing aids 202A-B that are capable of performing ear-to-ear communication using a plurality of channels of a wireless communication link 108 when hearing aid 202A is worn in or about the first ear of the wearer and hearing aid 202B is worn in or about the second ear of the wearer. The first ear can be either the right ear or the left ear, and the second ear is the opposite ear of the same wearer.

Hearing aid 202A represents an exemplary embodiment of hearing device 102A and can include a microphone 212A, a receiver 214A, a communication circuit 204A, and a controller 206A. Microphone 212A can receive a first input sound and produce a first microphone signal representative of the first input sound. Receiver 214A can produce a first sound using a first output signal and transmit the first sound to the first ear of the wearer. Communication circuit 204A represents an exemplary embodiment of communication circuit 104A can transmit a signal 210A to hearing device 202B via a specified channel selected from the plurality of channels of communication link 108 and receive a signal 210B from hearing device 202B using the specified channel. Signals 210A and 210B can each carry audio information for delivering to the wearer and/or control information for operation of the hearing aids 202A and 202B. Signal 210A carries a first packet. The first packet includes a first channel quality threshold, which is a minimum value of a quality parameter for the specified channel and is calibrated by hearing aid 202A. Signal 210B carries a second packet. The second packet includes a second channel quality threshold, which is the minimum value of the quality parameter for the specified channel and is calibrated by hearing aid 202B. Control circuit 206A represents an exemplary embodiment of control circuit 106A and can produce the first output signal by processing the first microphone signal and signal 210B. Control circuit 206A can also measure the quality parameter for the specified channel and perform an assessment the determines whether the specified channel is suitable for the ear-to-ear communication based on the measured value of the quality parameter and the second channel quality threshold received from hearing aid 202B. If the specified channel is not suitable, control circuit 206A can select another channel from the plurality of channels of communication link 108 to be the new specified channel.

Hearing aid 202B represents an exemplary embodiment of hearing device 102B and can include a microphone 212B, a receiver 214B, a communication circuit 204B, and a controller 206B. Microphone 212B can receive a second input sound and produce a second microphone signal representative of the second input sound. Receiver 214B can produce a second output sound using a second output signal and transmit the second sound to the second ear of the wearer. Communication circuit 204B represents an exemplary embodiment of communication circuit 104B can transmit signal 210B to hearing device 202A via the specified channel and receive signal 210A from hearing device 202A using the specified channel. Control circuit 206B represents an exemplary embodiment of control circuit 106B and can produce the second output signal by processing the second microphone signal and signal 210A. Control circuit 206B can also measure the quality parameter for the specified channel and perform an assessment the determines whether the specified channel is suitable for the ear-to-ear communication based on the measured value of the quality parameter and the first channel quality threshold received from hearing aid 202A. If the specified channel is not suitable, control circuit 206B can select another channel from the plurality of channels of communication link 108 to be the new specified channel.

Figure 3:
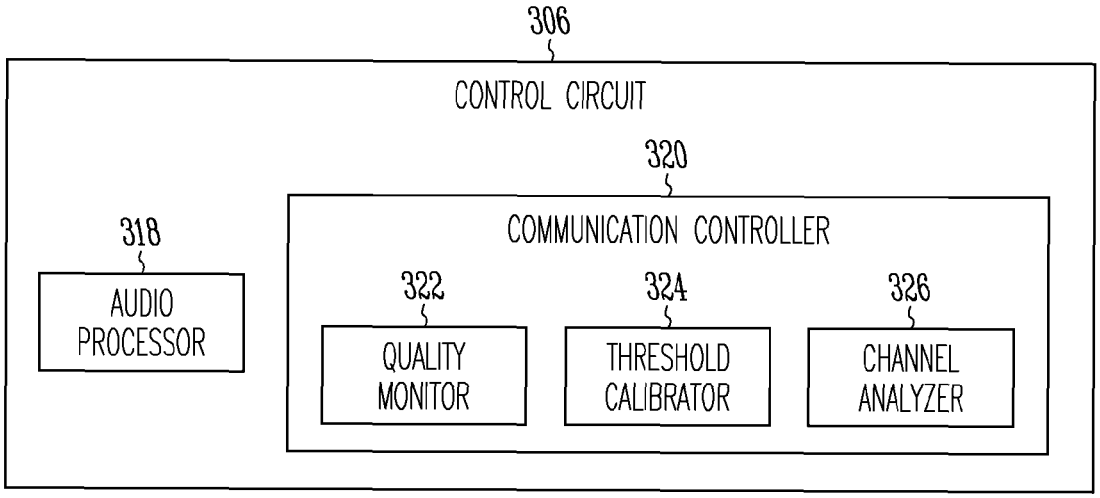
FIG. 3 is a block diagram illustrating an exemplary embodiment of a control circuit in each hearing aid of a pair of hearing aids, such as the pair of hearing aids of FIG. 2.

FIG. 3 is a block diagram illustrating an exemplary embodiment of a control circuit 306, which represent an exemplary embodiment of each of control circuits 206A-B. Control circuit 306 can include an audio processor 318 and a communication controller 320. Audio processor 320 can process signals carrying audio information to produce an output signal that can be used by a receiver or speaker to produce an audible sound. Examples of the signals carrying audio information include microphone signal and signal carrying audio information that is received via a wireless link. Communication controller 320 can include a quality monitor 322, a threshold calibrator 324, and a channel analyzer 326.

Quality monitor 322 can monitor quality of communication for the specified channel by measuring the quality parameter on the signal received via communication link 108 using the specified channel. In various embodiments, quality monitor 322 can make one or more measurements on the received packet to determine the measured value of the quality parameter. The quality parameter can be an SNR of the specified channel. Quality monitor 322 can measure an RSSI value for the specified channel on the received signal, measure an RSSIQ value when no signal is transmitted via the specified channel, and subtract the measured RSSIQ value from the measured RSSI value to result in an RSSI−RSSIQ value as the SNR.

Threshold calibrator 324 can determine the channel quality threshold for the specified channel, which is a minimum value of the quality parameter (such as a minimum SNR or minimum RSSI−RSSIQ value) at which the performance of the ear-to-ear communication is deemed acceptable. In various embodiments, the channel quality threshold can be calibrated by measuring the quality parameter and one or more measures of data transmission accuracy for the specified channel, and the channel quality threshold is the minimum value below which a data transmission error rate becomes unacceptable. In various embodiments, threshold calibrator 324 in one hearing aid can initiate a channel assessment process by including the calibrated channel quality threshold in a packet to be transmitted to the other hearing aid.

Channel analyzer 326 can determine whether the specified channel is suitable or useable for the ear-to-ear communication based on the value of the quality parameter measured by quality monitor 322 of the hearing aid (e.g., hearing aid 202A) on the received signal and the channel quality threshold received from the other hearing aid (e.g., hearing aid 202B). Channel analyzer 326 can select another channel from the plurality of channels of communication link 108 to be the specified channel in response to a determination that the specified channel is not suitable or useable. In an exemplary embodiment, channel analyzer 326 selects another channel when the value of the quality parameter measured by the hearing aid on the received packet falls below the channel quality threshold received from the other hearing aid. In various embodiments, channel analyzer 326 can select another channel from the plurality of channels on a random order, a pseudo random order, or a predetermined order.

Figure 4A:
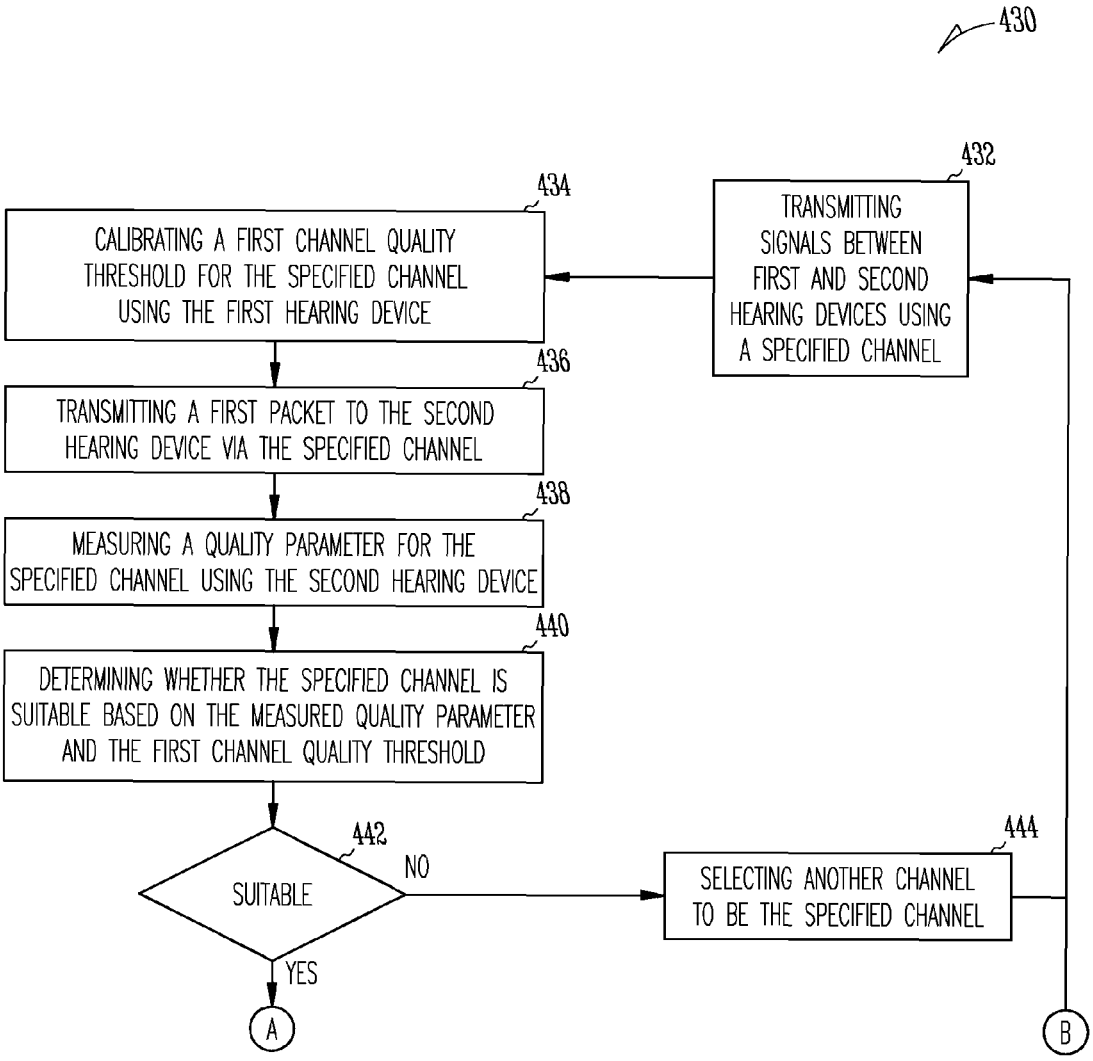
FIG. 4 (FIGS. 4A and 4B) is a flow chart illustrating an exemplary embodiment of a method for channel assessment in ear-to-ear communication between hearing devices.
Figure 4B:
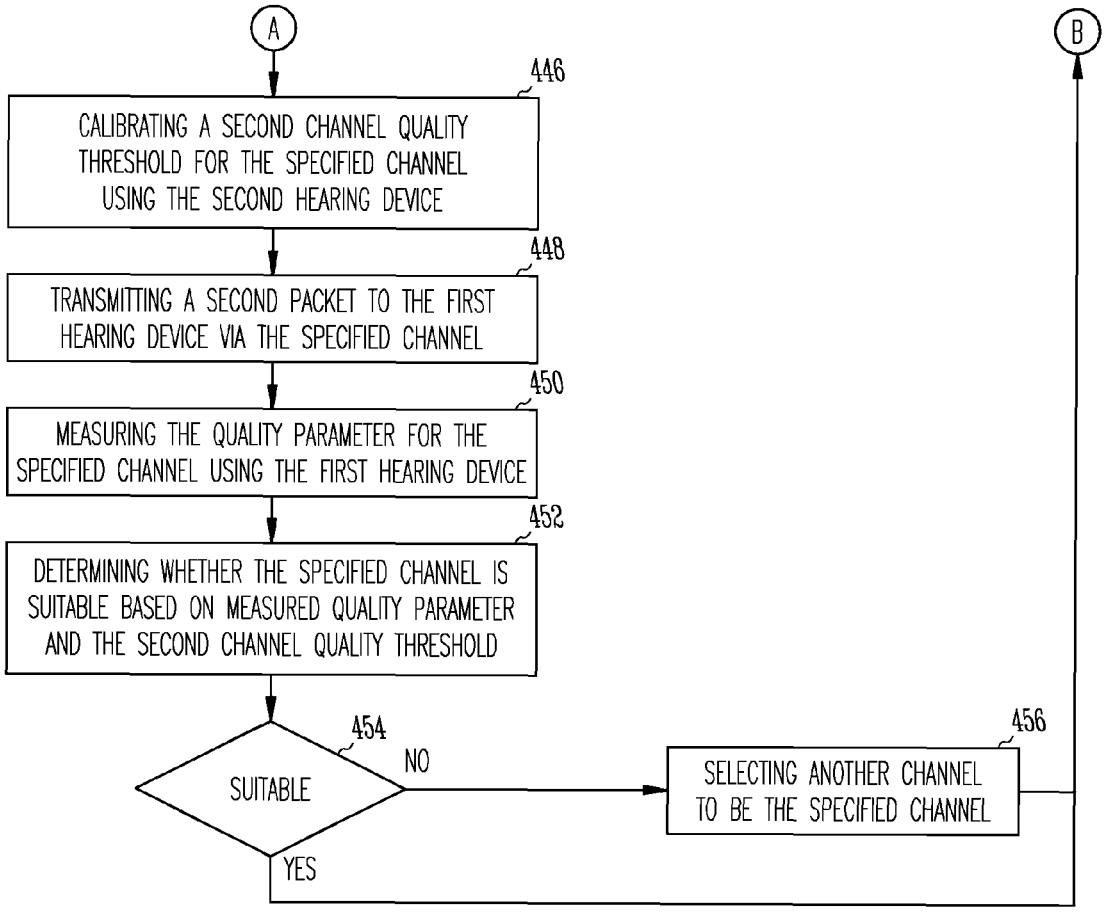

FIG. 4 (FIGS. 4A and 4B) is a flow chart illustrating an exemplary embodiment of a method 430 for channel assessment in ear-to-ear communication between hearing devices. While a pair of first and second hearing aids are discussed as an example, method 430 can be applied to any hearing devices performing ear-to-ear communication and configured to allow performance of this method. In an exemplary embodiment, hearing aids 202A-B are configured to perform method 430 as the first and second hearing aids discussed below.

Method 430 can be performed when the first hearing aid is worn in or about the first ear of the wearer and the second hearing aid is worn in or about the second ear of the wearer. The first ear can be either the right ear or the left ear, and the second ear is the opposite ear of the same wearer. At 432, signals are transmitted via a specified channel selected from a plurality of channels of a wireless communication link between the first hearing device and the second hearing device. In various embodiments, the signals being transmitted can include audio signals that carry audio information and/or control signals used for controlling operation of the hearing devices. Such transmission of the signals is ongoing while method 430 is performed.

At 434, a first channel quality threshold is calibrated for the specified channel using the first hearing device. The first channel quality threshold is a minimum value of a quality parameter for the specified channel as determined by the first hearing device. At 436, a first packet of the signals is transmitted from the first hearing device to the second hearing device. The first packet includes the calibrated first channel quality threshold. At 438, the quality parameter is measured for the specified channel using the second hearing device. At 440, whether the specified channel is suitable for the wireless communication is determined based on the value of the quality parameter measured by the second hearing device and the first channel quality threshold. At 444, if the specific channel is not suitable at 442, another channel from the plurality of channels is selected to be the specified channel.

At 446, a second channel quality threshold is calibrated for the specified channel using the second hearing device. The second channel quality threshold is a minimum value of the quality parameter for the specified channel as determined by the second hearing device. At 448, a second packet of the signals is transmitted from the second hearing device to the first hearing device. The second packet includes the calibrated second channel quality threshold. At 450, the quality parameter is measured for the specified channel using the first hearing device. At 452, whether the specified channel is suitable for the wireless communication is determined based on the value of the quality parameter measured by the first hearing device and the second channel quality threshold. At 456, if the specific channel is not suitable at 454, another channel from the plurality of channels is selected to be the specified channel.

In various embodiments, the channel quality threshold can be calibrated for each of the first and second hearing aids. In an exemplary embodiment, the calibration at least of steps 434 and 446 can include two measurements. The first measurement is a measurement of an RSSI value on the receiving hearing aid when a signal is sent from the transmitting hearing aid via a specified channel. The second measurement is the measurement of an RSSIQ value when no signal is sent between the hearing aids but background noise and interference are still present at the specified channel. By subtracting the RSSIQ from the second measurement from the RSSI value from the first measurement, an SNR (i.e., an RSSI−RSSIQ value) for the specified channel is obtained as the quality parameter. The channel quality threshold is determined as a minimum SNR (i.e., a minimum RSSI−RSSIQ value) with which the specified channel is deemed acceptable for performing the ear-to-ear communication. Once the hearing aids have the calibrated channel quality thresholds, they can than begin the iterative process of identifying a channel suitable for the ear-to-ear communication from the plurality of channels. The following is a discussion of the iterative process using RSSI-based quality parameter as an example.

An RSSI measurement process can be initiated by the first hearing aid. At 436, the first hearing aid can transmit a first packet with audio information and a first channel quality threshold (the channel quality threshold calibrated for the first hearing aid) embedded in the first packet via a specified channel. The second hearing aid receive the first packet from the first hearing aid via the specified channel, and can then begin to perform a channel assessment. For the channel assessment, at 438, the second hearing aid takes one or more RSSI measurements of the first packet received from the first hearing aid, and extracts the first channel quality threshold from the first packet while playing the audio. After the first packet has been received and when the first hearing aid is not transmitting a signal, the second hearing aid takes one or more RSSI measurements of the surrounding environment (referred to as RSSIQ measurement). The second hearing aid then subtracts the measured RSSIQ value from the measured RSSI value, resulting in an RSSI−RSSIQ value, and compares this RSSI−RSSIQ value to the first channel quality threshold extracted from the first packet at 440. If the RSSI−RSSIQ value is greater than or equal to the first channel quality threshold at 442, the second hearing aid maintains the ear-to-ear communication on the specified channel. If the RSSI−RSSIQ value is below the first channel quality threshold, the second hearing aid can initiate a request to change the channel for the ear-to-ear communication from the specified channel to a different channel selected from the plurality of channels at 444. In various embodiments, this different channel can be chosen from the plurality of channels randomly, pseudo-randomly, or in a predefined order.

If the channel assessment performed by the second hearing aid determines that the specified communication channel is acceptable for the ear-to-ear communication at 442, the second hearing aid can embed a second channel quality threshold (the channel quality threshold calibrated for the second hearing aid) in a second packet with audio information, and transmit the second packet to the first hearing aid using the same specified channel at 448. The first hearing aid receives the second packet, takes one or more RSSI measurements on the second packet, and extracts the second channel quality threshold from the second packet while playing the audio. At 450, after the second packet has been sent and when the second hearing aid is not transmitting signal, the first hearing aid take one or more RSSI measurements of the surrounding environment (i.e., RSSIQ measurement). The first hearing aid then subtracts the measured RSSIQ value from the measured RSSI value, resulting in an RSSI−RSSIQ value, and compares this RSSI−RSSIQ value to the second channel quality threshold extracted from the second packet at 452. If the RSSI−RSSIQ value is greater than or equal to the second channel quality threshold at 454, the first hearing aid maintains the ear-to-ear communication on the specified channel. If the RSSI−RSSIQ value is below the second channel quality threshold at 454, the first hearing aid can initiate a request to change the channel for the ear-to-ear communication from the specified channel to a different channel selected from the plurality of channels at 456. In various embodiments, this different channel can be chosen from the plurality of channels randomly, pseudo-randomly, or in a predefined order.

Method 430 can be performed repeatedly during the ear-to-ear communication. The channel assessment performed by the first and second hearing aids alternately can repeat and continue as long as the first and second hearing aids are in a bidirectional ear-to-ear communication mode. This channel selection process allows each of the first and second hearing aid to request channel changes. Poor performance of the ear-to-ear communication via a channel may result from weak signal strength at the frequency of that channel and/or high noise and interference levels at the frequency of that channel.

The present subject matter can also allow the channel quality threshold for each hearing aid to be updated periodically and dynamically. The channel quality threshold for a hearing aid can be always embedded in a data packet transmitted to the other hearing aid. This allows the channel quality threshold for each hearing aid to be calibrated by taking several RSSIQ measurements while no signal is being transmitted. In various embodiments, the channel quality threshold can be calibrated by adding a predetermined offset to a RSSI−RSSIQ value resulting from the several RSSI measurements.

Hearing devices typically include at least one enclosure or housing, a microphone, hearing device electronics including processing electronics, and a speaker or "receiver." Hearing devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that digital hearing aids include a processor. For example, control circuits 106A-B, 206A-B, and 306 can each be implemented in such a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

Various embodiments of the present subject matter support wireless communications with a hearing device. In various embodiments the wireless communications can include standard or nonstandard communications. Some examples of standard wireless communications include, but are not limited to, Bluetooth™, low energy Bluetooth, IEEE 802.11(wireless LANs), 802.15 (WPANs), and 802.16 (WiMAX). Cellular communications may include, but are not limited to, CDMA, GSM, ZigBee, and ultra-wideband (UWB) technologies. In various embodiments, the communications are radio frequency communications. In various embodiments the communications are optical communications, such as infrared communications. In various embodiments, the communications are inductive communications. In various embodiments, the communications are ultrasound communications. Although embodiments of the present system may be demonstrated as radio communication systems, it is possible that other forms of wireless communications can be used. It is understood that past and present standards can be used. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, ATM, Fibre-channel, Firewire or 1394, InfiniBand, or a native streaming interface. In various embodiments, such connections include all past and present link protocols. It is also contemplated that future versions of these protocols and new protocols may be employed without departing from the scope of the present subject matter.

In various embodiments, the present subject matter is used in hearing devices that are configured to communicate with mobile phones. In such embodiments, the hearing device may be operable to perform one or more of the following: answer incoming calls, hang up on calls, and/or provide two way telephone communications. In various embodiments, the present subject matter is used in hearing devices configured to communicate with packet-based devices. In various embodiments, the present subject matter includes hearing devices configured to communicate with streaming audio devices. In various embodiments, the present subject matter includes hearing devices configured to communicate with Wi-Fi devices. In various embodiments, the present subject matter includes hearing devices capable of being controlled by remote control devices.

It is further understood that different hearing devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing devices, such as hearing aids, headsets, speakers, cochlear implants, bone conduction devices, personal listening devices, headphones, and other hearing devices.

The present subject matter may be employed in hearing devices having additional sensors. Such sensors include, but are not limited to, magnetic field sensors, telecoils, temperature sensors, accelerometers and proximity sensors.

The present subject matter is demonstrated for hearing devices, including hearing aids, including but not limited to, behind-the-ear (BTE), in-the-ear (ITE), in-the-canal (ITC), receiver-in-canal (RIC), invisible-in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing system configured to be worn by a wearer having first and second ears, comprising:

first and second hearing devices configured to perform wireless communication with each other using a plurality of channels when the first hearing device is worn in or about the first ear and the second hearing devices is worn in or about the second ear, the first and second hearing devices each including:

a communication circuit configured to receive a signal transmitted from the other hearing device of the first and second hearing devices using a specified channel selected from the plurality of channels, the signal carrying a packet including a channel quality threshold being a minimum value of a quality parameter determined by the other hearing device for the specified channel; and a control circuit including a communication controller configured to measure the quality parameter for the specified channel, calibrate another channel quality threshold for the specified channel for transmitting to the other hearing device, and determine whether the specified channel is useable based on the measured value of the quality parameter and the channel quality threshold included in the received packet.

2. The hearing system of claim 1, wherein the quality parameter comprises a signal to noise ratio (SNR), and the communication controller comprises a quality monitor configured to determine the SNR.

3. The hearing system of claim 2, wherein the quality monitor is configured to measure a received signal strength indicator (RSSI) for the specified channel and determine the SNR based on measurements of the RSSI.

4. The hearing system of claim 3, wherein the quality monitor is configured to measure a value of the RSSI on the received signal (RSSI value), to measure a value of the RSSI when no signal is transmitted via the specified channel (RSSIQ value), and to calculate the SNR by subtracting the measured RSSIQ value from the measured RSSI value (RSSI–RSSIQ value).

5. The hearing system of claim 4, wherein the quality monitor is configured to measure the RSSI value by making a plurality of measurements of the RSSI on the packet and measure the RSSIQ value by making another plurality of measurements of the RSSI when no signal is transmitted via the specified channel.

6. The hearing system of claim 2, wherein the communication controller comprises a threshold calibrator configured to update the channel quality threshold dynamically and to initiate the determination of whether the specified channel is useable in response to a change in the channel quality threshold.

7. The hearing system of claim 6, wherein the communication controller comprises a channel analyzer configured to select another channel from the plurality of channels to be the specified channel in response to the measured value of the quality parameter falling below the channel quality threshold included in the received packet.

8. The hearing system of claim 7, wherein the channel analyzer is configured to select another channel randomly from the plurality of channels to be the specified channel in response to the measured value of the quality parameter falling below the channel quality threshold included in the received packet.

9. The hearing system of claim 1, wherein the first and second hearing devices comprise a pair of binaural hearing aids.

10. The hearing system of claim 9, wherein the binaural hearing aids each further comprise a microphone and a receiver, the microphone configured to receive an input sound and produce a microphone signal representative of the sound, the receiver configured to produce a sound using an output signal and transmit the sound to one of the first and second ears, and wherein the control circuit further comprises an audio processor configured to produce the output signal by processing the microphone signal and the signal received from the other hearing aid of the binaural hearing aids.

11. A method for wireless communication between a first hearing device worn in or about a first ear of a wearer and a second hearing device worn in or about a second ear of the wearer, comprising:

transmitting signals via a specified channel selected from a plurality of channels of a wireless communication link between the first hearing device and the second hearing device;

calibrating a first channel quality threshold for the specified channel using the first hearing device, the first channel quality threshold being a minimum value of a quality parameter for the specified channel as determined by the first hearing device;

transmitting a first packet of the signals from the first hearing device to the second hearing device, the first packet including the calibrated first channel quality threshold;

measuring the quality parameter for the specified channel using the second hearing device; and determining whether the specified channel is suitable for the wireless communication based on the value of the quality parameter measured by the second hearing device and the first channel quality threshold.

12. The method of claim 11, further comprising selecting another channel from the plurality of channels to be the specified channel in response to the value of the quality parameter measured by the second hearing device falling below the first channel quality threshold.

13. The method of claim 12, further comprising:

calibrating a second channel quality threshold for the specified channel using the second hearing device, the second channel quality threshold being a minimum value of the quality parameter for the specified channel as determined by the second hearing device;

transmitting a second packet of the signals from the second hearing device to the first hearing device, the second packet including the calibrated second channel quality threshold;

measuring the quality parameter for the specified channel using the first hearing device; and determining whether the specified channel is suitable for the wireless communication based on the value of the quality parameter measured by the first hearing device and the second channel quality threshold.

14. The method of claim 13, further comprising selecting another channel from the plurality of channels to be the specified channel in response to the value of the quality parameter measured by the first hearing device falling below the second channel quality threshold.

15. The method of claim 14, wherein selecting another channel from the plurality of channels to be the specified channel comprises selecting another channel from the plurality of channels randomly.

16. The method of claim 14, wherein selecting another channel from the plurality of channels to be the specified channel comprises selecting another channel from the plurality of channels according to a predetermined order.

17. The method of claim 14, wherein the quality parameter comprises a signal-to-noise ratio (SNR).

18. The method of claim 17, wherein measuring the quality parameter for the specified channel comprises measuring values of a received signal strength indicator (RSSI) for the specified channel.

19. The method of claim 18, wherein measuring the quality parameter for the specified channel using the second hearing device comprises:

measuring a value of the RSSI on the received first packet (first RSSI value);

measuring a value of the RSSI when no signal is transmitted via the specified channel (first RSSIQ value); and calculating the SNR by subtracting the measured first RSSIQ value from the measured first RSSI value, and measuring the quality parameter for the specified channel using the first hearing device comprises:

measuring a value of the RSSI on the received second packet (second RSSI value);

measuring a value of the RSSI when no signal is transmitted via the specified channel (second RSSIQ value); and calculating the SNR by subtracting the measured second RSSIQ value from the measured second RSSI value.

20. The method of claim 19, wherein measuring the first RSSI value comprises making a plurality of measurements of the RSSI on the first packet received by the second hearing device, and measuring the second RSSI value comprises making a plurality of measurements of the RSSI on the second packet received by the first hearing device.

* * * * *